US006533207B2

(12) United States Patent
Eugster et al.

(10) Patent No.: US 6,533,207 B2
(45) Date of Patent: Mar. 18, 2003

(54) METHOD AND ARRANGEMENT FOR PRODUCING A ROLL FROM PRINTED PRODUCTS

(75) Inventors: Albert Eugster, Strengelbach (CH); Peter Bartschi, Oftringen (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/855,716

(22) Filed: May 16, 2001

(65) Prior Publication Data

US 2001/0045489 A1 Nov. 29, 2001

(30) Foreign Application Priority Data

May 17, 2000 (EP) ..... 00810428

(51) Int. Cl.[7] ..... B65H 18/22; B65H 23/185; B65H 39/14

(52) U.S. Cl. ..... 242/420.5; 242/528; 242/541.3

(58) Field of Search ..... 242/528, 420.5, 242/541.3; 270/60; 271/151

(56) References Cited

U.S. PATENT DOCUMENTS

| | | | | |
|---|---|---|---|---|
| 3,214,110 A | * | 10/1965 | Ross | 242/420.5 |
| 3,518,857 A | * | 7/1970 | Hancock et al. | 242/420.5 |
| 3,749,989 A | * | 7/1973 | Pittner | 242/420.5 |
| 4,519,039 A | * | 5/1985 | Surana et al. | 242/420.5 |
| 4,523,751 A | | 6/1985 | Merkli | |
| 4,550,883 A | * | 11/1985 | Boss | 242/528 |
| 4,651,941 A | * | 3/1987 | Muller | 242/528 |
| 4,898,336 A | * | 2/1990 | Reist | 242/528 |
| 4,901,935 A | * | 2/1990 | Reist | 242/528 |
| 4,995,563 A | * | 2/1991 | Kalin | 242/528 |
| 5,259,563 A | * | 11/1993 | Kakwaki et al. | 242/420.5 |

FOREIGN PATENT DOCUMENTS

| | | |
|---|---|---|
| CH | 682 657 A5 | 10/1993 |
| EP | 0 298 267 A1 | 1/1989 |
| EP | 0 826 616 A 1 | 3/1998 |

* cited by examiner

*Primary Examiner*—John M. Jillions
(74) *Attorney, Agent, or Firm*—Venable; Robert Kinberg; Chad C. Anderson

(57) ABSTRACT

A method for producing a roll from printed products in a winding operation includes winding the printed products with winding tape onto a winding core; driving a winding rug with a first drive, wherein the winding rug is arranged on the underside of the winding core and fitted against the winding core for rotating the winding core; driving a winding tape supply with a second drive, wherein the winding tape is unwound from the winding tape supply; and maintaining a predetermined tape tension during the winding operation. Maintaining the predetermined tape tension includes measuring speed and distance with measurement devices at the first and second drives to obtain measured values, computing the diameter of the winding tape supply with the measured values, and regulating a rotational moment with the computed diameter of the winding tape supply to maintain the tension.

16 Claims, 1 Drawing Sheet

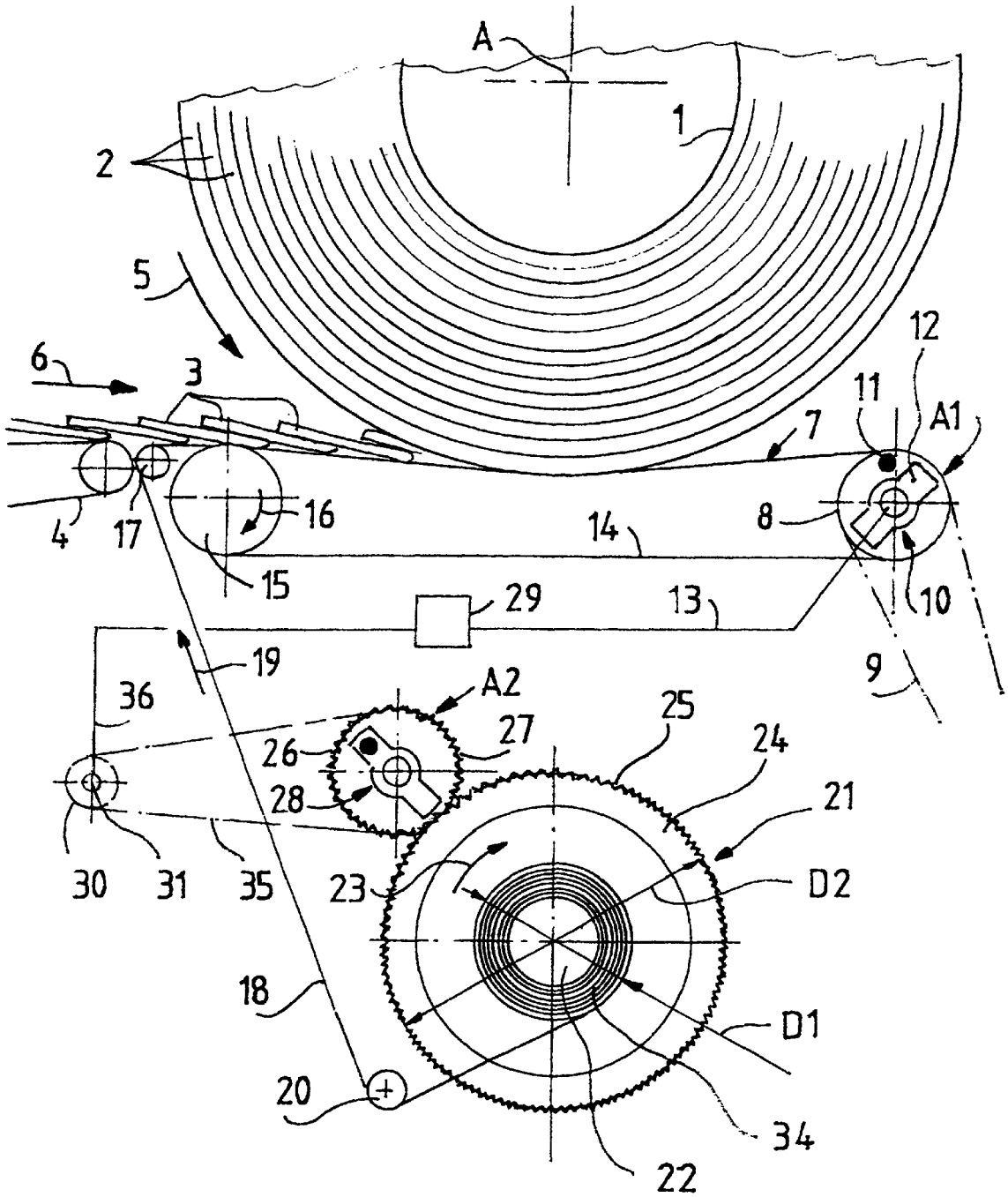
A
1
2
5
6
3
12
11
A1
7
4
17
16
8
14
15
29
13
10
19
9
36
A2
27
25
26
24
28
21
30
31
35
23
D2
18
D1
20
34
22

METHOD AND ARRANGEMENT FOR PRODUCING A ROLL FROM PRINTED PRODUCTS

CROSS REFERENCE TO RELATED APPLICATIONS

Priority is claimed with respect to European Patent Application No. 00810428.3-2314 filed on May 17, 2000, in the European Patent Office, the disclosure of which is herein incorporated by reference.

BACKGROUND OF THE INVENTION

The invention relates to a method and apparatus for producing a roll of printed products during a winding operation.

Methods and arrangements for producing rolls from printed products, for example newspapers and magazines, are known from prior art, for example, from the references CH-A-682 657 and EP-A-0 826 616 by the assignee of the present invention. Two winding tapes are generally used for winding the printed products into a roll. The winding tapes are supplied to the roll from a winding tape supply used as a storage element. These winding tapes can be, for example, plastic tapes. In place of several winding tapes, however, the present method can use only one winding tape, which is pulled off a winding tape supply.

To obtain a good winding quality, a constant and controlled tape tension must be maintained when winding printed products into a roll. When the winding quality is poor, the danger exists that a roll will fall apart during transport, which leads to considerable expenditure. A constant tape tension is achieved by means of a tape tension control. The rotational moment acting upon the tape depends on the filling degree of the winding tape supply. Conventionally, the roll diameter of the winding tape on the tape supply roll is scanned to determine the filling degree. A scanning lever placed against the outside of the winding tape roll is used, for example, for this purpose. However, scanners of this type are subject to malfunctions. The use of an optical scanner, for example a laser, is conceivable and suggests itself for scanning the tape roll. However, this would lead to problems due to the varied surface quality of the winding tapes.

SUMMARY OF THE INVENTION

It is an object of the invention to create a method and apparatus of the aforementioned type, which is subject to fewer malfunctions.

The above and other objects are solved by a method according to the invention for producing a roll from printed products in a winding operation. The method includes the steps of winding the printed products with winding tape onto a winding core in a manner of scaled flow, wherein the winding tape has ends and one end of the winding tape is attached to the winding core; driving a winding rug with a first drive, wherein the winding rug is arranged on the underside of the winding core and fitted against the winding core for rotating the winding core; driving a winding tape supply from which the winding tape is unwound with a second drive; and maintaining a predetermined tape tension during the winding operation. The step of maintaining the predetermined tape tension includes measuring at least one of speed and distance with measurement devices for each of the first drive and second drive to obtain measured values, computing the diameter of the winding tape supply with the measured values, and regulating a rotational moment or torque of the winding tape supply with the computed diameter of the winding tape supply to maintain the tape tension.

According to another aspect of the invention, there is provided an apparatus for producing a roll of printed products during a winding operation. The apparatus includes a winding core; a winding rug arranged on the underside of the winding core and fitted against the winding core for rotating the winding core; a winding tape supply having a diameter; at least one winding tape with two ends, wherein one end is attached to the winding core and the other end is attached to the winding tape supply, wherein the printed products are wound with the winding tape onto the winding core to form a spiral roll of printed products; a first drive driving the winding rug; a second drive driving the winding tape supply; and an apparatus for controlling tape tension for maintaining a predetermined tape tension during the winding operation.

The apparatus for controlling tape tension includes speed and distance measuring devices provided to each of the first drive and second drive for respectively providing measured values for the first drive and measured values for the second drive, wherein the measured values for the first drive and the second drive are compared during the winding operation to compute the diameter of winding tape supply and to regulate the apparatus for controlling tape tension.

With the method and apparatus according to the invention, a scanning device for the winding tape supply can be omitted. The winding tape roll diameter is determined by comparing the speed and distance measurements of the winding tape and computing the diameter. Optionally, either only the speed or distance of the winding tape can be measured. Preferably, measurements are taken on the winding rug and at the winding tape supply. As a result of comparing these measurements, the diameter of the winding tape roll is computed. The computed diameter is used to control the rotational moment of the winding tape drive and to maintain a predetermined tape tension.

According to one modification of the invention, the speed and distance measurements are measured with clock generators. Clock generators can be designed to be reliable and inexpensive. The clock generators can be used to continuously measure the speeds or distance. Furthermore, clock generators require little space and do not hinder the winding or unwinding operations. In one embodiment, a clock generator is provided on the drive wheel of the winding rug and on at least one drive wheel for the winding tape supply.

The method according to the invention is also suitable if two or more winding tapes are used. With a method of this type, several winding tape supplies and a corresponding number of winding tapes are provided. Each winding tape supply can be provided with a speed and distance measuring device.

By comparing the speeds and the distances of the different winding tape rolls, a tear in a tape can be detected at once and the necessary measures taken immediately. In particular, a tape can be fixed immediately after the tape is torn.

In case of a tear in the tape, the tape length is changed by cutting out the section with the tear. If this occurs several times, the difference in the lengths for the winding tapes can be comparably large and the danger exists that the shortest winding tape may be torn from the winding core. This occurrence can be reliably avoided with the method and apparatus of the present invention if the winding tape drive that drives the shortest winding tape is used as reference drive. Thus, when using clock generators, the clock generator showing the fastest speed is used as reference to calculate the rotational moment.

According to another modification of the method the present invention, the diameter of the winding tape roll or rolls is continuously computed during the winding operation and a paper feed is switched automatically to a another roll once a predetermined residual tape length is reached. The residual tape length depends on the location of use for the roll and is preferably defined at the respective winding station.

BRIEF DESCRIPTION OF THE DRAWING

A preferred embodiment of the invention is explained in the following with the aid of a single FIGURE. FIG. 1 schematically shows a side view of an arrangement according to the invention.

DETAILED DESCRIPTION OF THE INVENTION

Referring to FIG. 1, there is shown an arrangement comprising a winding core 1, which is positioned such that it can rotate inside a winding station that is not shown herein. During the winding operation, the winding core 1 rotates in the direction of arrow 5 about axis A. The printed products 3, which are supplied in a scaled flow on a conveyor 4 and moving in the direction of arrow 6, are supplied undershot and tangential to the roll. At the same time, at least one winding tape 18 is pulled off a winding tape supply 21 and is fed via deflection rollers 20 and 17 to the roll. The winding tape 18 is fastened at one end to the winding core 1 and at the other end to a core or mandrel 22 of the winding tape supply 21. The winding tape 18 is preferably manufactured from plastic. The wound printed products 3 and winding tape 18 form spiral layers 2 on the winding core.

The roll is driven by a winding rug 7 or other suitable apparatus. The winding rug 7 comprises an endlessly circulating tape or belt 14, a drive roller 8, and a deflection roller 15. The belt 14 of the winding rug 7 can be pivoted around the axis of the drive roller 8 and is pressed against the roll by means of a tensioning device not shown in FIG. 1 and known in the art. The winding rug 7 is driven by a first drive A1. The first drive A1 comprises an endless drive belt 9 that is fitted around the drive roller 8. During the winding operation, the drive roller 8 is driven such that the deflection roller 15 turns in the direction of arrow 16. Thus, in the FIG. 1, the printed products 3 move from left to right. During the unwinding operation, the rotational directions are reversed, meaning the deflection roller 15 turns in counter-clockwise direction and the printed products 3 are transported from right to left. Hence, the arrangement of the present invention can be used for winding as well as unwinding.

The winding tape 18 is pulled off the winding tape supply 21 during the winding operation in the direction of arrow 19 and fed to the roll. Maintaining a constant, controlled tape tension is important for a good winding quality. The tape tension is controlled by regulating a second drive A2. In accordance with this tension regulation, the rotational moment or torque acting upon the winding tape supply 21 depends on the filling degree or the diameter D1 of winding tape roll 34. Thus, the larger the diameter D1, the higher the rotational moment. The regulated second drive A2 comprises a drive wheel 26 with outer toothing 27, which meshes with an outer toothing 25 of a toothed wheel 24 of the winding tape supply 21 and engages the diameter D2. The second drive A2 comprises an endless drive belt 35 that is fitted around the drive wheel 26 and is operatively connected to a coupling 31 of a drive motor 30. During the winding operation, the second drive A2 turns the toothed wheel 24 in the direction of arrow 23. During the unwinding operation, the toothed wheel 24 is correspondingly turned in the opposite direction.

Clock generators 10, 28 are respectively arranged on the drive roller 8 and the drive wheel 26 to determine the diameter D1. At least one of the speed and distance of the winding tape are measured at the drive roller 8 and the drive wheel 26 continuously with the clock generators 10, 28. The clock pulses from these two clock generators 10, 28 are fed via lines 13, 36 to a computer or processor 29 where the clock pulse numbers are compared. The diameter D1 is then computed from this comparison. The clock pulse number for clock generator 10 generally remains constant during the winding operation. The clock pulse number for clock generator 28 depends on the diameter D1. The smaller the diameter D1, the higher the rotating speed for toothed wheel 24 and, correspondingly, the rotating speed of drive wheel 26 or the clock pulse number. The drive A2 is controlled based on the computed actual diameter D1, preferably by making an adjustment to the coupling 31. This coupling 31 preferably is a hysteresis coupling, which is known in the art.

The two clock generators 10, 28 respectively comprise a non-moving receiving component 11 as well as an impulse transmitter 12 that rotates along with the drive shaft 8 or the drive wheel 26. The pulse can be triggered either optically or electronically, in a known manner. The clock generators 10, 28 can also be replaced by other suitable means for detecting the speed or distance. These means can also be arranged at another location. The clock generator 28, for example, could be operatively connected to the winding mandrel 22.

As another option, if the speed of the drive A1 remains constant, clock generator 10 is not necessary. In accordance with this embodiment, only the speed and distance of the winding tape at drive A2 need to be measured to compute the diameter D1 and thus, regulate tape tension.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A method for producing a roll from printed products in a winding operation, the method comprising the steps of:

winding the printed products with winding tape onto a winding core with an underside in a manner of scaled flow, wherein the winding tape has ends and one end of the winding tape is attached to the winding core;

driving a winding rug with a first drive, wherein the winding rug is arranged on the underside of the winding core and fitted against the winding core for rotating the winding core;

driving a winding tape supply with a second drive, wherein the winding tape has a diameter and is unwound from the winding tape supply; and maintaining a predetermined tape tension during the winding operation, including measuring at least one of speed and distance with measurement devices for each of the first drive and second drive to obtain measured values, computing the diameter of the winding tape supply from the measured values, and regulating a rotational moment of the winding tape supply with the computed diameter of the winding tape supply to maintain the tape tension.

2. The method according to claim 1, wherein the step of computing the diameter of the winding tape supply comprises comparing clock pulses from clock generators provided to each of the measuring devices of the first drive and second drive.

3. The method according to claim 1, wherein the regulating step includes regulating the rotational moment of the winding tape supply by a coupling of the second drive.

4. The method according to claim 3, wherein the coupling is a hysteresis coupling.

5. The method according to claim 1, wherein the winding tape supply comprises at least two winding tapes that rotate, and wherein the step of computing the diameter includes using as a reference the clock generator of the winding tape that rotates fastest.

6. The method according to claim 1, the further comprising the step of switching automatically to another winding tape core once a predetermined residual winding tape length is reached.

7. The method of claim 1, wherein the step of computing the diameter comprises comparing the measured values.

8. An apparatus for producing a roll of printed products during a winding operation, comprising:

a winding core with an underside;

a winding rug arranged on the underside of the winding core and fitted against the winding core for rotating the winding core;

a winding tape supply having a diameter;

at least one winding tape with two ends, wherein one end is attached to the winding core and the other end is attached to the winding tape supply, wherein the printed products are wound with the winding tape onto the winding core to form a spiral roll of printed products;

a first drive driving the winding rug;

a second drive driving the winding tape supply;

means for regulating a rotational moment of the winding tape supply for maintaining a predetermined tape tension during the winding operation;

at least one of speed and distance measuring devices provided to each of the first drive and second drive for respectively providing measured values for the first drive and measured values for the second drive; and means for comparing the measured values for the first drive and the second drive during the winding operation to compute the diameter of the winding tape supply, the means for controlling the rotational moment being responsive to the diameter of the winding tape supply to maintain the predetermined tape tension.

9. The apparatus according to claim 8, wherein the speed and distance measuring devices comprise clock generators which produce a number of clock pulses, and wherein diameter is computed by comparing the number of clock pulses from the clock generators of the measurement devices of the first drive and second drive.

10. The apparatus of claim 8, wherein the second drive includes a coupling for regulating the winding tape supply.

11. The apparatus of claim 10, wherein the coupling is a hysteresis coupling.

12. The apparatus of claim 9, wherein the winding tape comprises at least two winding tapes that rotate, and wherein the clock generator corresponding to the winding tape with a fastest relative rotation is used as a reference for maintaining tape tension.

13. The apparatus of claim 8, further comprising another winding core; and wherein, during the winding operation, a residual winding tape length is constantly computed and once a predetermined residual winding tape is reached, the another winding core replaces the winding core.

14. The apparatus of claim 8, wherein clock generators of the measurement devices provided to the first drive and the second drive are respectively arranged on the first drive and the second drive.

15. The apparatus of claim 8, wherein the first drive includes a drive roller and wherein the apparatus further comprises a clock generator arranged on the drive roller.

16. The apparatus of claim 8, wherein the second drive includes a drive wheel and wherein the apparatus further comprises a clock generator arranged on the drive wheel.

* * * * *